US006024181A

United States Patent [19]

Richardson et al.

[11] Patent Number: 6,024,181

[45] Date of Patent: Feb. 15, 2000

[54] PORTABLE TOP DRIVE

[75] Inventors: Allan S. Richardson; Robert Hope, both of Calgary, Canada

[73] Assignee: Nabors Industries, Inc., Houston, Tex.

[21] Appl. No.: 08/839,715

[22] Filed: Apr. 15, 1997

Related U.S. Application Data

[63] Continuation of application No. 08/305,177, Sep. 13, 1994, Pat. No. 5,755,296.

[51] Int. Cl.[7] ..... E21B 3/04; E21B 7/02

[52] U.S. Cl. ..... 175/162; 175/195; 166/75.1; 166/85; 173/213

[58] Field of Search ..... 175/162, 52, 85, 175/220, 195; 166/75.1, 77.5, 78, 85; 173/213, 147, 151; 414/22.57, 22.59

[56] References Cited

U.S. PATENT DOCUMENTS

| | | | |
|---|---|---|---|
| 3,754,606 | 8/1973 | Ward . | |
| 4,830,119 | 5/1989 | Haney et al. . | |
| 4,832,552 | 5/1989 | Skelly . | |
| 4,865,135 | 9/1989 | Moses . | |
| 5,107,940 | 4/1992 | Berry . | |
| 5,138,871 | 8/1992 | Dinsdale . | |
| 5,251,709 | 10/1993 | Richardson . | |
| 5,381,867 | 1/1995 | Berry | 175/85 |
| 5,433,279 | 7/1995 | Tessari et al. . | |

FOREIGN PATENT DOCUMENTS

| | | |
|---|---|---|
| A-2119749 | 11/1983 | United Kingdom . |
| A-2228025 | 8/1990 | United Kingdom . |

OTHER PUBLICATIONS

"Reinventing the Rig," CPA Review, Oct. 1991.

Tesco Drilling Technology brochure on the portable hydraulic top drive. (Date unknown).

Canrig Drilling Technology Ltd. brochure entitled "Drilling Technology for the Nineties". (Date unknown).

World Oil Composite Catalog '92/'93 (Vol. 2), Gulf Publishing Company, Houston, TX, p. 3464.

"Land Rigs Benefit From Portable Top Drive System," Oil & Gas Journal, vol. 92, No. 11, Mar. 14, 1994, Tulsa, Ok, pp. 73–74.

World Oil Composite Catalog '92/'93 (vol. 2), Gulf Publishing Company, Houston, TX, pp. 540–541.

"Portable Top Drive Cuts Horizontal Drilling Company," Oil & Gas Journal, vol. 214, No. 11, Nov. 1993, Houston, TX, p. 83.

*Primary Examiner*—Terry Lee Melius
*Attorney, Agent, or Firm*—Baker & Botts, L.L.P.

[57] ABSTRACT

A portable top drive drilling unit that is a self-contained assembly of components adapted for quick installation in a drilling rig and which requires a minimum of modification to the rig structure.

7 Claims, 9 Drawing Sheets

8
7
6
5
4
2
3
1
8
7
6
5
4
2
3
1

8
7
6
5
50
2
4
55
3
1

FIG. 4B
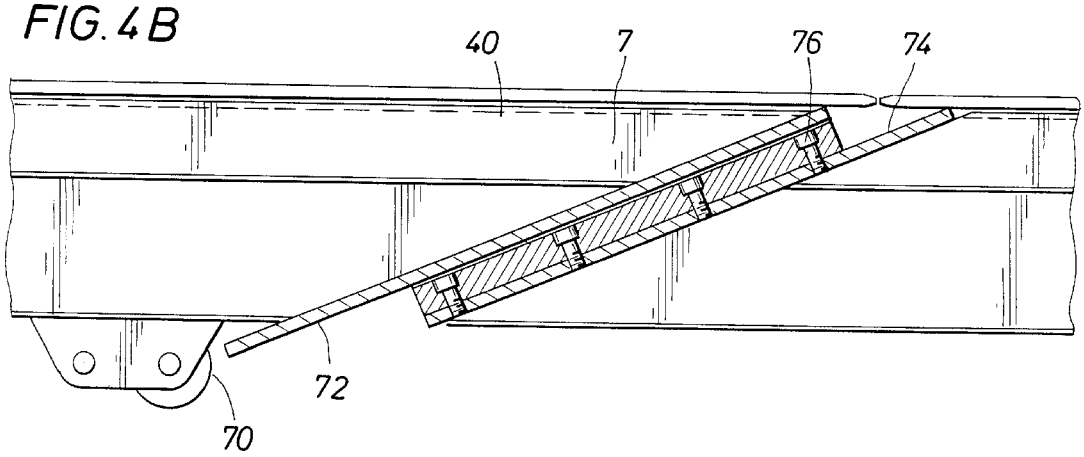
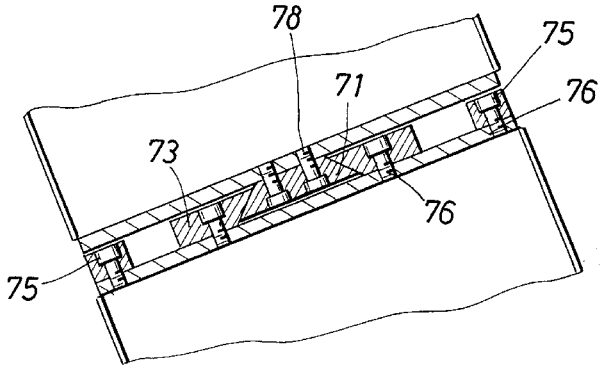
FIG. 4C
FIG. 5A
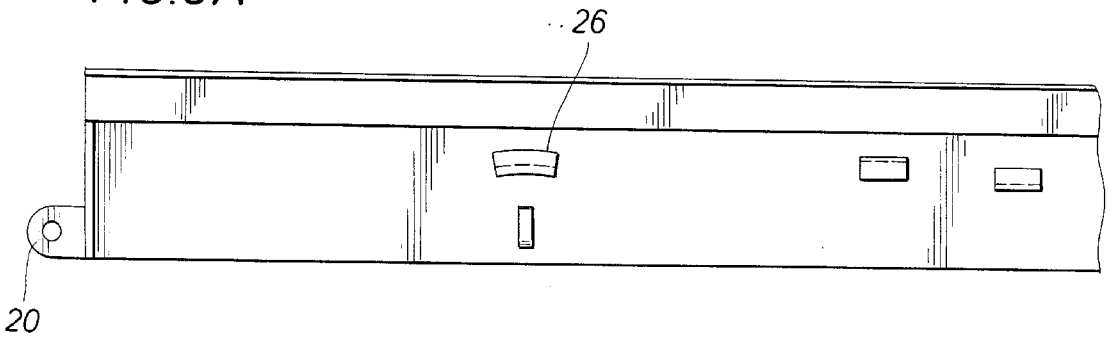
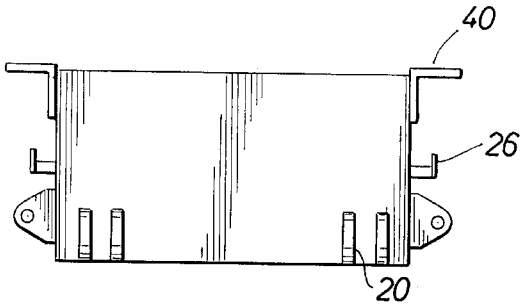
FIG. 5B

PORTABLE TOP DRIVE

This is a continuation of application Ser. No. 08/305,177, filed Sep. 13, 1994, now U.S. Pat. No. 5,755,296.

BACKGROUND OF THE INVENTION

This invention relates to well drilling and, in one aspect, to a portable rotary top drive assembly.

In conventional rotary drilling of wells, particularly oil and gas wells, the pipe string (to which is attached a drilling bit at the end) is rotated by means of a rotary table located on the platform floor. The pipe is connected to the rotary table by means of a special connector between the table and pipe—a kelly. Drilling is accomplished in increments of single pipe lengths. When drilling has advanced one pipe length, drilling is stopped, the pipe de-coupled from the kelly and another length (typically 31 feet or about 9.4 meters) re-coupled and drilling is resumed.

Systems for rotary drilling an entire stand (typically three pipe lengths, about 93 feet or 28.3 meters) from a drive unit suspended at the top of the pipe string (top drive units) have been devised in recent years. The concept of top drives on drilling rigs dates back to the 1920s, but practical systems date only from the 1980s. It is relatively easy to make a machine to rotate pipe from the top, and many attempts were made to apply the idea to oilfield drilling rigs. However, a major problem of such rotary drive systems is in providing means to prevent reactive rotation of the top drive. In conventional systems this is done by attachment of the rotary table to the rig floor. In top drives the drive must be prevented from rotating in reaction to the rotation of the pipe string through the entire travel of the drill string, virtually the length of the mast. This requires a special torque reaction system. Most early top drive designs were unsuccessful because they were unable to efficiently handle drilling tubulars (pipe or tubing) within conventional drilling rig architecture. That is, they could not easily accommodate connection and disconnection of pipe lengths, moving and handling of the pipe strings or provide a workable torque reaction mechanism. In the 1980s there was developed a top drive system complete with pipe handler (breakout wrench, lift tilt, overdrill provisions and inside well control) that overcame the pipe handling limitations. This system allowed the top drive to achieve its conceptual benefits of continuously drilling triple stands of pipe and circulating and reaming the hole while tripping in and out of the hole (removing drill pipe and reinserting pipe strings in the drilled hole). The system has proven technically and commercially successful, and as many as 300 units have been used. However, these units are heavy and require significant field modification of the derricks. Most are installed on offshore rigs because activity levels are high and offshore day rates (costs of the operations and crew) are sufficiently high to justify the high purchase and installation costs. Moreover, offshore derricks are typically large enough to accommodate the relatively large and heavy top drives and torque reaction assemblies. These systems have not received much use on land-based rigs for a number of reasons. Land rig day rates are usually too low to justify very high capital costs solely on the basis of time savings, and the systems are too large to fit into land rig masts without extensive modification. Land rig masts are not strong enough to withstand the drilling torque reaction induced by top drives without significant reinforcement. Moreover, rigs outfitted with these top drive systems cannot efficiently be moved and re-rigged as needed.

Thus, smaller, lighter and more compact systems were needed and have been developed. Since land rigs are typically portable, they are designed with only enough space inside the top of the mast structure to accommodate a traveling block and pipe handling facilities. Thus, installing a torque reaction system is a major problem. It is not feasible to have the mast structure itself absorb the torque reaction. To do so would require expensive stress analysis of the mast and modification and additions to the rig structure that would be not only costly but would reduce portability of the rig. The solution to this problem has been to provide a separate torque reaction guide, vertical structures designed to guide the top drive assembly over the top of the drill string and to absorb torque reaction. Since tying the guide to the mast has many of the disadvantages of using the mast itself to absorb the torque reaction, the guides must be supported in another way. U.S Pat. No. 4,865,135 describes a system having a pair of bushings encased in a torque case. One bushing is attached to the top drive frame and the other pinned to the other bushing and slidably attached to a vertical shaft.

An improved torque guide, in which the drive assembly is slidably attached to a vertical guide consisting essentially of a rectangular monorail, is described in U.S. Pat. No. 5,251,709 and its counterpart, U.K Patent No. 2,228,025, published Oct. 21, 1992. This system is mechanically simpler than other designs and is more easily installed in existing small land rigs. The guide is attached at the top to the derrick crown and at the bottom to the platform floor or to the strong structure of a lower section of the mast. This torque guide system is very successful in absorbing torque reaction and is finding significant use. However, it requires some field rigging and is normally customized to fit one rig only. It is, therefore, less than ideal for retrofit installation in rigs already in use. Transporting equipment and personnel to the field, less efficient field work relative to shop work and especially down time of the rig (with a 3 to 5 person drilling crew idled during rigging) are costly.

There are, however, many operating land rigs that can benefit from top drive systems and many that cannot be economically retrofitted with the previous systems. What is needed is a truly portable, self-contained system that can be installed in an existing small rig in minimum time and with minimum modification to the rig structure. Ideally, a portable system should be capable of installation and be operational in one day and have little, if any, custom fitting or rigging in the mast. It should be easily removable, easily transportable and capable of use in a variety of rig configurations. It is especially important that utility and service connections be self-contained in a portable top drive assembly unit. Often, connections for utilities (electric, air and hydraulic) and services (drilling mud and cooling air, etc.) are more time consuming than installation of the torque guide itself. Thus, a truly successful portable top drive system for use in land rigs needs to be lightweight, compact and adaptable to a variety of rig architectures. It should be self-contained in its structural elements and its utility and service connections.

This invention is such a portable top drive assembly system.

SUMMARY OF THE INVENTION

The invention is a self-contained assembly of components necessary to quickly and removably erect a torque guide and attendant top drive unit in a drilling rig mast.

In one embodiment, the invention is a portable top drive assembly for drilling of wells that comprises: (a) a top drive unit; (b) a torque drive guide comprising at least two sections adapted to be connected; (c) structural skid members on which the top drive unit and the sections of torque guide may be removably disposed; (d) means for connecting the torque guide to structural members of a drilling rig; and (e) means to connect the top drive unit to the torque guide, the top drive being fitted with a frame that is adapted to be movably fitted on the monorail torque guide.

The invention preferably comprises the above components and a skid mount that also forms the lower section of the torque guide, a top section of the torque guide that is adapted to be quickly connected to the crown of a drilling rig, a lower section that is adapted to be connected to structural members of a drilling derrick mast and self-contained utility and service cables and hoses with suitable connectors.

Advantages and other features will be apparent from the following description and from the claims.

BRIEF DESCRIPTION OF THE DRAWING

FIGS. 4B and 4C are a side view and an end view, respectively, of an alternative torque guide assembly.

FIGS. 5A and 5B are is a side and end view of a section of torque guide.

FIGS. 8C1, 8C2, and 8C3 are a side view, an end view, and a plan view, respectively, of a top section of torque guide adapted for connection to a top connector as shown in FIGS. 8A and 8B.

DESCRIPTION OF THE PREFERRED EMBODIMENTS

In one embodiment, the portable top drive assembly of this invention comprises:

a top drive unit;

a skid mount to which is attached a first section of torque guide;

an assembly attached to the side of the skid mount forming a ladder and utility cable tray;

a torque guide monorail comprising connectable sections sufficient to extend from the top of a drilling rig mast to about 6 to 8 feet (2 to 2.6 meters) from the platform floor, i.e., typically about 120 to 140 feet (about 39 to 46 meters) total length (including the skid mount) when fully extended;

means to connect a top section of the torque guide to the crown of the rig mast;

means to connect a lower skid mount to the rig mast, and preferably to a back spreader beam; and optionally utility cables, service hoses, control lines and their related connectors adapted to be installed in the assembly for use in operation; and a service element container, such as a van or portable housing, which may contain an electrical rectifying unit (such as an SRC or variable frequency AC drive) and auxiliary hydraulic pumps and connections and which is adapted for use with the top drive assembly.

Figure 1:
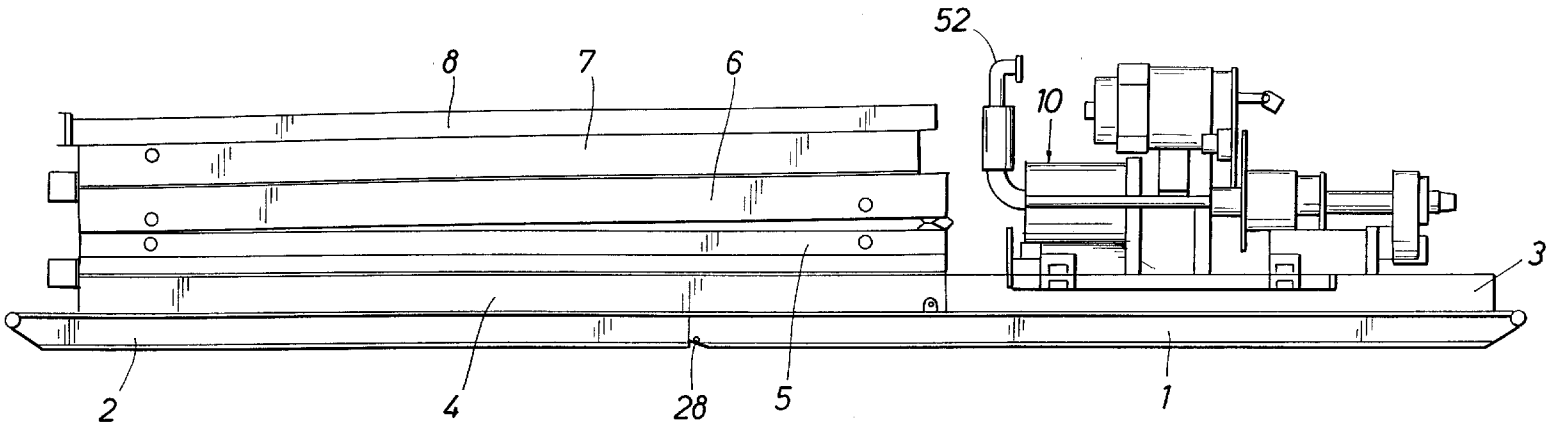
FIG. 1 is an illustration of a top drive assembly shown in a configuration for transport.
Figure 2C:
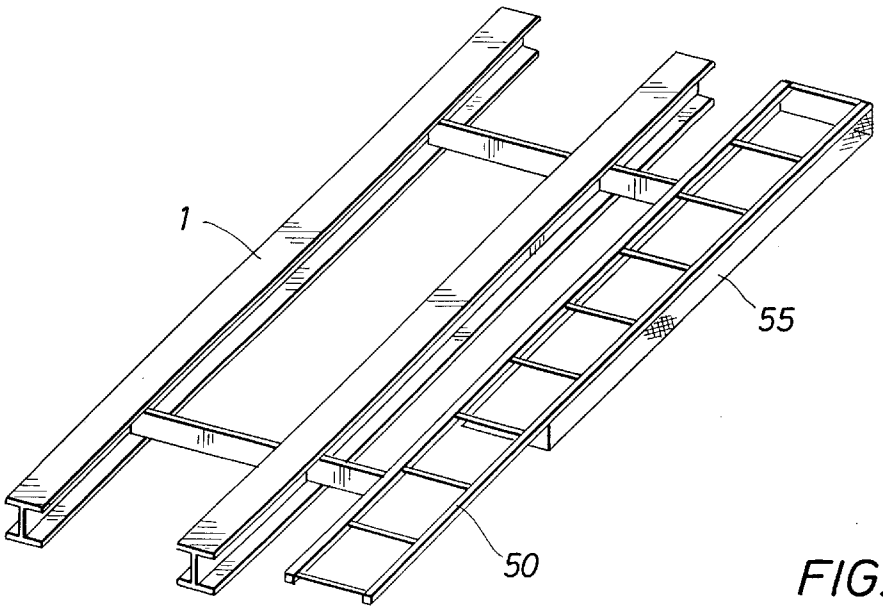
FIG. 2C is a perspective view of a side mount assembly of a torque guide assembly.
Figure 2A:
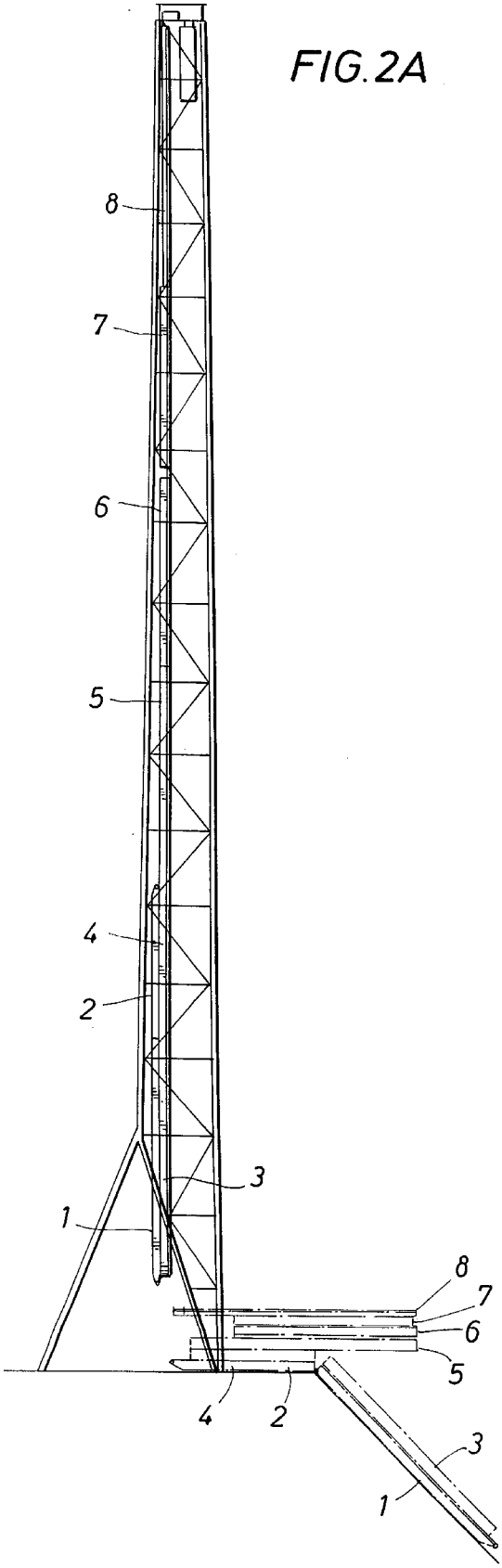
FIGS. 2A and 2B are side and front views of a drilling rig with a torque guide in place for operation.
Figure 2B:
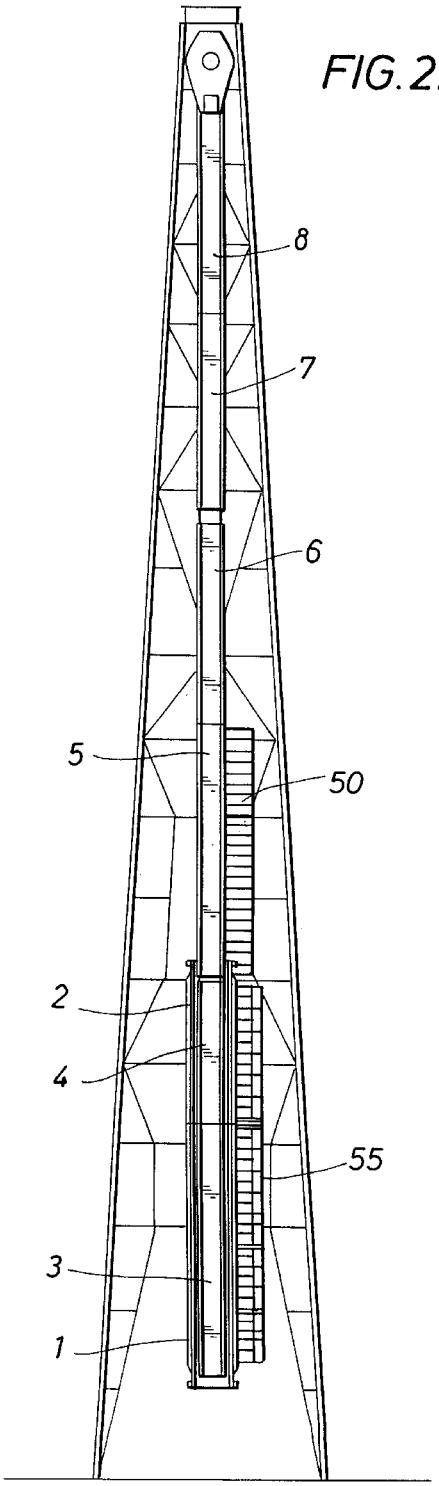
Figure 3:
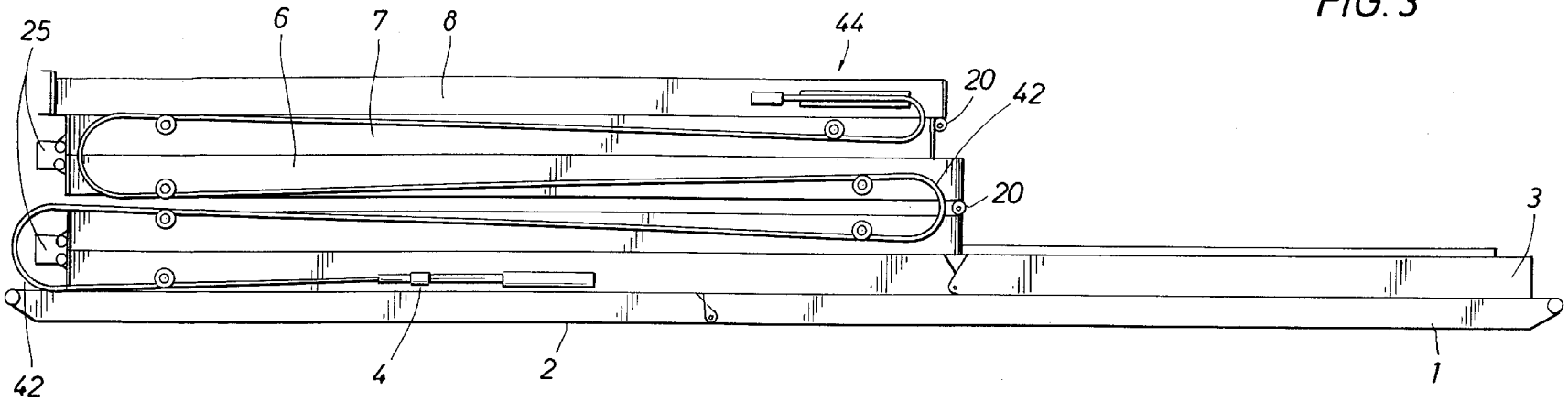
FIG. 3 is a side view of a torque guide assembly showing tensioning cables in transport position.

An embodiment of the invention is illustrated in FIGS. 1, 2 and 3. FIG. 1 shows the assembly in its transport position; that is, folded on a mount for transport. The mount is suitably constructed of steel I beams. The skids are sized to provide adequate strength to support the entire top drive assembly for transport and to be able to withstand the stress of the turning moment (torque) in reaction to rotation of the rotary top drive in drilling operation. The skids also serve as the means through which the torque guide is attached to the mast structure. Typically the skids will be constructed of steel wide flange (WF) beams having depths of about 10 inches (25 cm), flange widths of about 8 to 10 inches (20 to 25 cm) and flange thickness of about 0.5 inch (12 to 13 mm). Stainless or other stronger metals may be used to reduce weight and size, but would not often be cost justified. The skid beams are spaced apart at least the width of a torque guide section, typically about 24 inches (or about 60 cm). Preferably, the skids will be spaced apart about 36 inches (about 90 cm). The WF beams of the skids are connected by cross members that are welded, bolted or otherwise attached. Referring to FIG. 1, sections 3 and 4 of the torque guide are mounted on the skid sections 1 and 2. These first sections of torque guide need not be detached from the skids during use and can therefore be permanently mounted to the skids. Skid assemblies 1 and 2 are hinged at 28. Hinging of the skids facilitates positioning of the assembly securely on the rig floor platform and allows more convenient erection of the torque guide sections into a mast. In its transport configuration, torque guide sections 4, 5, 6 and 7 are hinged together and stacked on top of the skid assembly as shown. Hinges 25 are attached to the torque guide, and hinges 20 on the opposite side of the torque guide section are boxed to accommodate the depth of the torque guide section when unfolded. This type of hinge does not protrude forward of the torque guide face in the working position. The box section for the hinges 20 is of the same width as the torque guide.

The skids may be any desired length within certain practical limits. They should be as long as can be conveniently handled. It is especially desirable that they be shorter than the inside of a standard shipping container, usually 39.5 feet (about 13 meters). Therefore, a 39 foot 4 inch (12.9 meters) overall length is ideal. The skids must be longer than the top drive assembly. The difference in the length of the skids and the top drive unit will dictate the allowable length of the torque guide sections. For example, if the skids are 39 feet (12.8 meters) and the top drive assembly about 15 feet (4.9 meters) (typically 12 to 18 feet or 3.9 to 5.9 meters in length), the torque guide sections can be about 15 to 26 feet (4.9 to 8.5 meters). This is a convenient length that allows the assembly to be made up of two skid sections with torque guide sections attached and four additional torque guide sections. Many rigs have a 142 foot (about 46 meters) mast. Therefore, the total length of the torque guide will be about 132 to 134 feet (43.3 to 44 meters) (140 feet less about 6 to 8 feet (the distance the bottom of the torque guide is suspended from the drill platform floor)). The guide sections may be of equal or different lengths. It is preferable that the lower section or sections be of the same length as the skid section to which they are attached.

Skids longer than about 24 feet (7.9 meters) are more conveniently built in two hinged sections, as shown in FIG. 1. This allows the assembly to be pulled only partially onto the rig platform floor, with the remaining section resting on a pipe ramp. This provides a safer and more trouble-free installation of the top drive assembly into a rig mast. The top pin (28 of FIG. 1) of the hinged skid section is removed, and the skid mount with the top drive assembly and guide sections is pulled up a ramp on the front of the rig to a point where the second hinged section is clear of the top of the ramp. At that point the skids are secured on the ramp. This allows the second hinged section to be laid flat on the platform floor and the first section to remain at a slope on the ramp. Ends of the torque guide sections will protrude over the edge of the floor. From this position the top drive assembly, torque guide and attendant utility service cable rack and cables are hoisted into vertical position in the rig mast. The skids remain secure on the floor and pipe ramp until pulled into vertical position.

Figure 6A:
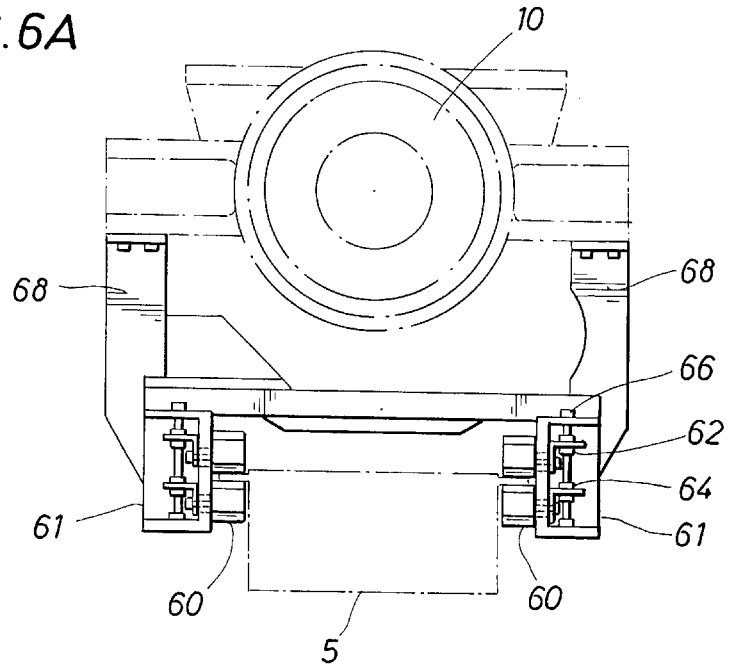
FIGS. 6A and 6B are a side view and an end view, respectively, of a torque guide connector for connecting a top drive unit to a torque guide.
Figure 6B:
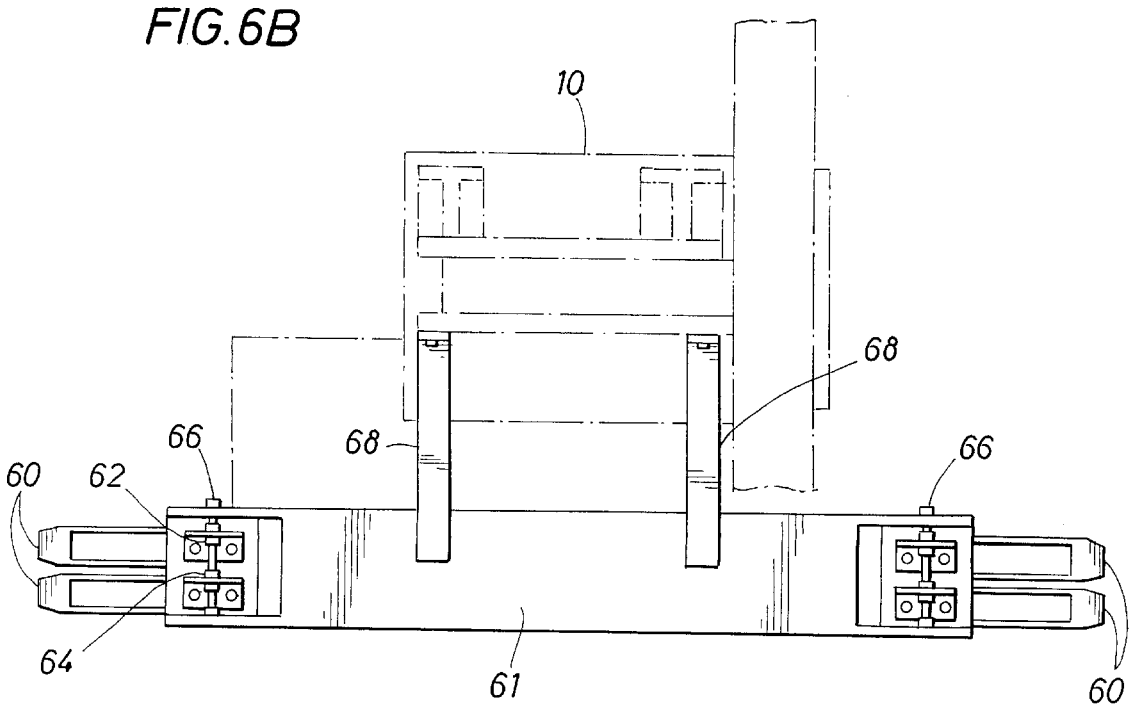

The torque guide sections illustrated in this embodiment are of the monorail type described in U.S. Pat. No. 5,251,709, which in relevant part is incorporated herein by reference. This torque guide is a steel monorail track of closed, hollow, rectangular cross-section as shown in FIG. 5. The rectangular cross-section is about 24 inches (about 60 cm) by 8 to 12 inches (20 to 30 cm) with wall thickness of the metal of about 0.25 to 0.5 inches (12 to 14 mm). It may be formed of two members welded together. It may also be constructed of pipes welded together or any other design, so long as it has the strength to provide torque resistance, low lateral bending and can be fitted with guide means for movably attaching a top drive unit. Other suitable designs for movably attaching a top drive unit to the torque guide are illustrated in U.S. Pat. No. 5,251,709. In the guide illustrated in FIG. 5, the top drive is attached through slides. These are shown in detail in FIG. 6. FIG. 6A is a top view of the guide showing the monorail torque guide 5 in dotted profile. The guide track is attached to the top drive unit 10 by the frame members 68 that, in turn, are attached to the slide runners 60. The slide runners are attached to the frame 61 through bolts and lock nuts 62, 64 and 66. Attachment with bolts as shown allows the location of the top drive unit to be adjusted laterally to position it exactly over the drill hole. Since the torque guide will generally be fixed in place, the lateral position of the drive unit can be adjusted to move it closer or away from the torque guide to position it as desired. Other means of adjusting the position of the top drive unit relative to the torque guide may be used. For example, it may be bolted or clamped with shims or connected through adjustable hydraulic cylinders. Connection through hydraulic cylinders will allow remote positioning.

Extended from one side of the skid assembly, and connected to it, is a service mount assembly, a perspective view of which is shown in FIG. 2C. This is preferably welded, as shown at 9, or otherwise attached to the right side of the skid beam. It is desirably connected to position the ladder assembly slightly above the skid beams. The mount is preferably designed to provide a ladder that can be used in maintenance of the upper service connections. This ladder should be of sufficient length (usually the length of the skid beams) to extend to about 72 feet (about 23.6 meters) elevation when the torque guide assembly is in place, as shown in FIG. 2A. The service mount ladder will typically be about the length of the skid sections and fitted at the top with a mounting for a remote air blower (if an electric motor drive is used). The top portion also includes electrical, hydraulic and control line connections.

If hinged sections of torque guide are used, it is necessary to provide means for securing the sections together when assembled. That is, it is important that the sections not be allowed to flex at the hinges when in operating position. This is accomplished in one embodiment by tensioning cables that attach to each side of the torque guide. The cable is connected at the top and bottom of the torque guide by means that allow the length of the cable to be adjusted, preferably by means of hydraulic cylinders. The cables 42 in FIG. 3 must be long enough to be bent around sections of torque guide when the sections are stacked, as shown in FIG. 3. When assembled, the cables are pulled tight vertically through guides 26 (FIG. 5) on the sides of the torque guide. These guides are positioned on the torque guide on the side of the centerline away from the hinge, as shown in FIG. 5. Thus, when tightened, the cables pull the hinged sections together and prevent flexing. While the cables can be connected to the torque guide by any suitable means, it is preferred that they be connected through hydraulic cylinders 44, which, when retracted, pull the cables tight. Less costly screw type cable tensioners can also be used. Hydraulic connectors allow the tensioning cable to be remotely controlled. To achieve desired force within the dimensional constraints, the cylinders can be ganged; that is, two or more cylinders may be connected in series. Alternatively, the hinged sections may be secured by other means, such as pinning them together or bolting or latching them to prevent flexing.

Figure 4A:
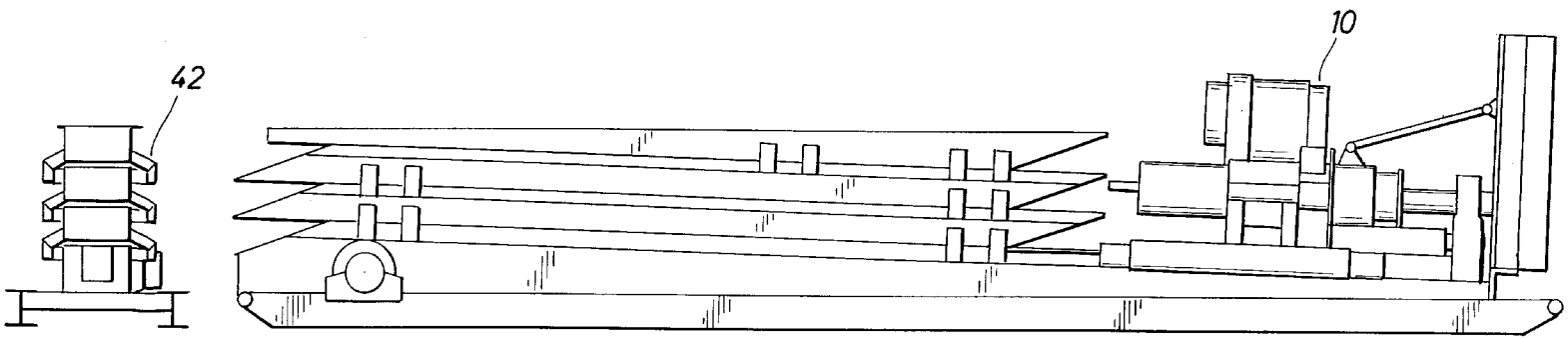
FIG. 4A is a plan view of an alternative top drive assembly.

An alternative torque guide embodiment that does not have hinged connections is illustrated in FIGS. 4A and 4B. The sections are slidably connected by a sloped sliding connection at the end of each section as shown at 42 of FIG. 4. The monorail guide sections are similar to the hinged ones but are not connected prior to being pulled into vertical position. FIG. 4B is a plan view of a guide section. End 72 of section 6 is faced with pins 76, and the end of another section 7 is faced with pins 78 (FIG. 4B). Roller 70 allows sections 6 and 7 to easily move on each other from a stacked position. Sections 6 and 7 may be grooved to provide a recess for roller 70, which will allow the sections to lay flat one on the other. Section 7 will move past section 6 until it comes to the end. The sloped end of 7 slides down the sloped section end of section 6, and the pins engage the pin boxes 71, 73 and 75. This connection, of course, occurs with the guide in the vertical position, and so long as the sections are in vertical tension, they remain connected. When the guide is taken down, tension is released and the end joints disengage. As a safety measure, they may be provided with means to secure the sections together while in use. This can be done by pinning, bolting or other suitable means easily provided by those skilled in the art.

Figure 7B:
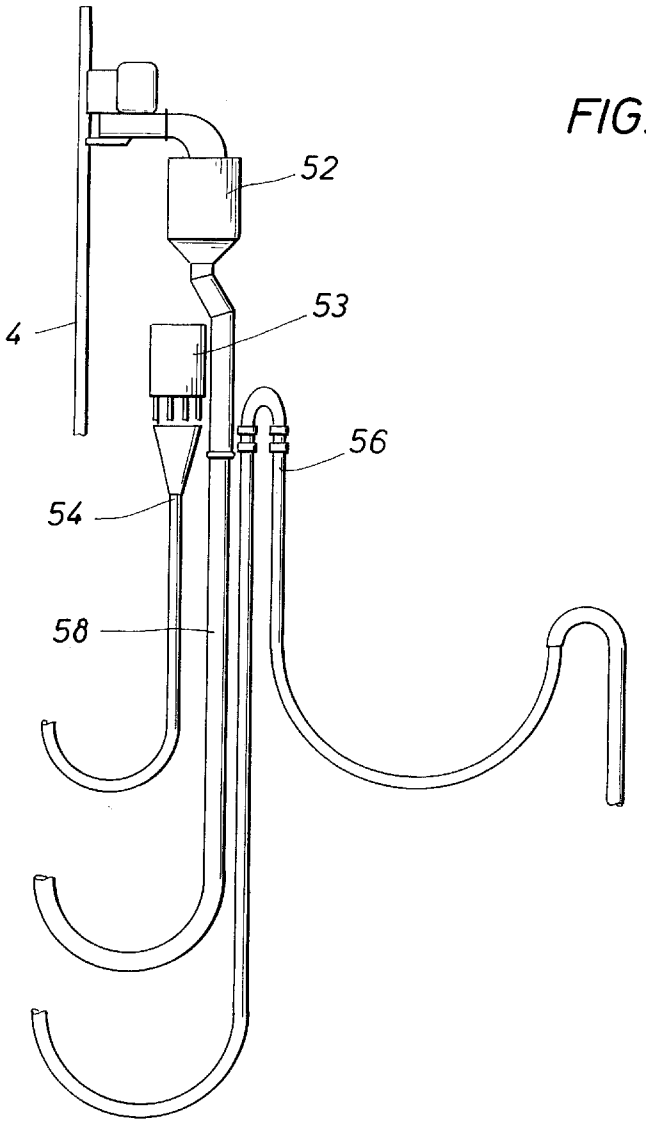
FIGS. 7A and 7B are a side view and a front view, respectively, of a utility and blower housing assembly.
Figure 7A:
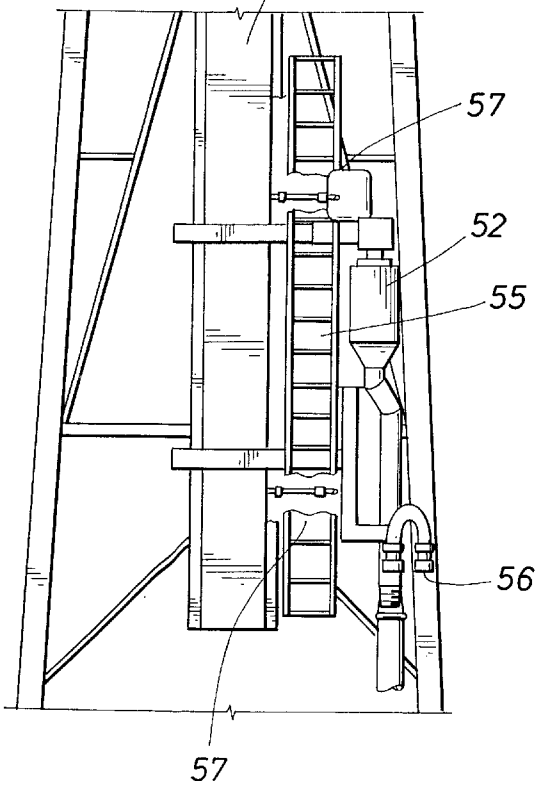
Figure 8B:
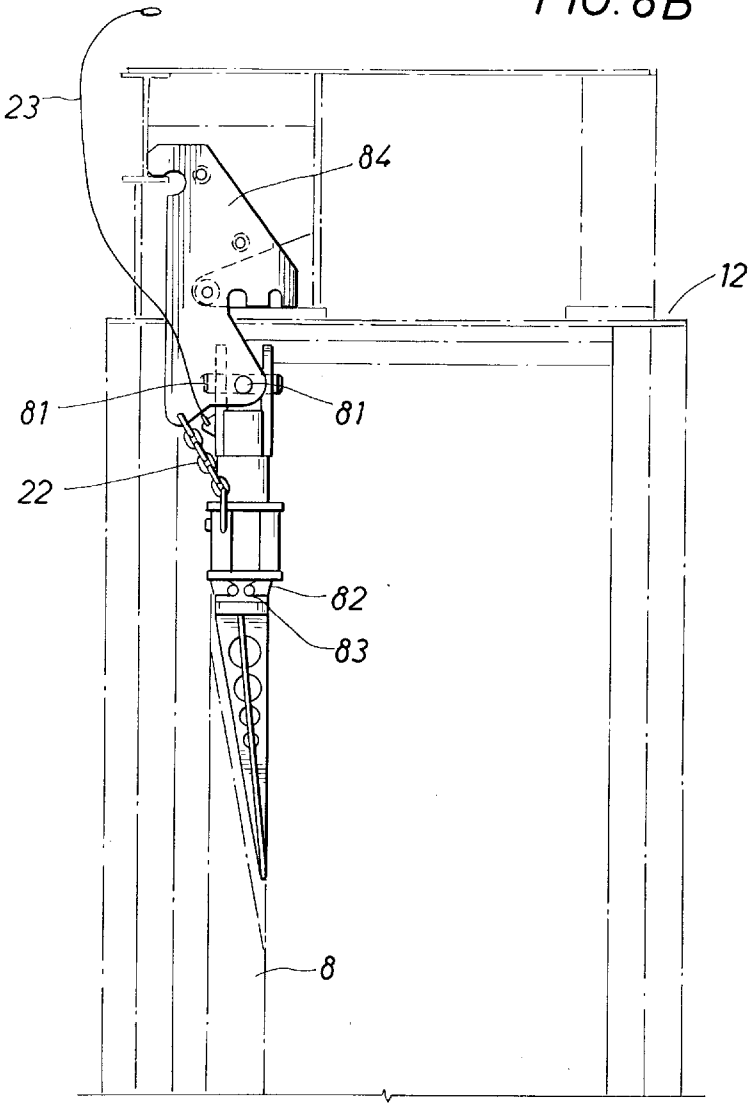
FIGS. 8A and 8B are a side view and a front view, respectively, of a top connector for connecting a torque guide to the crown of a drilling rig mast.
Figure 8A:
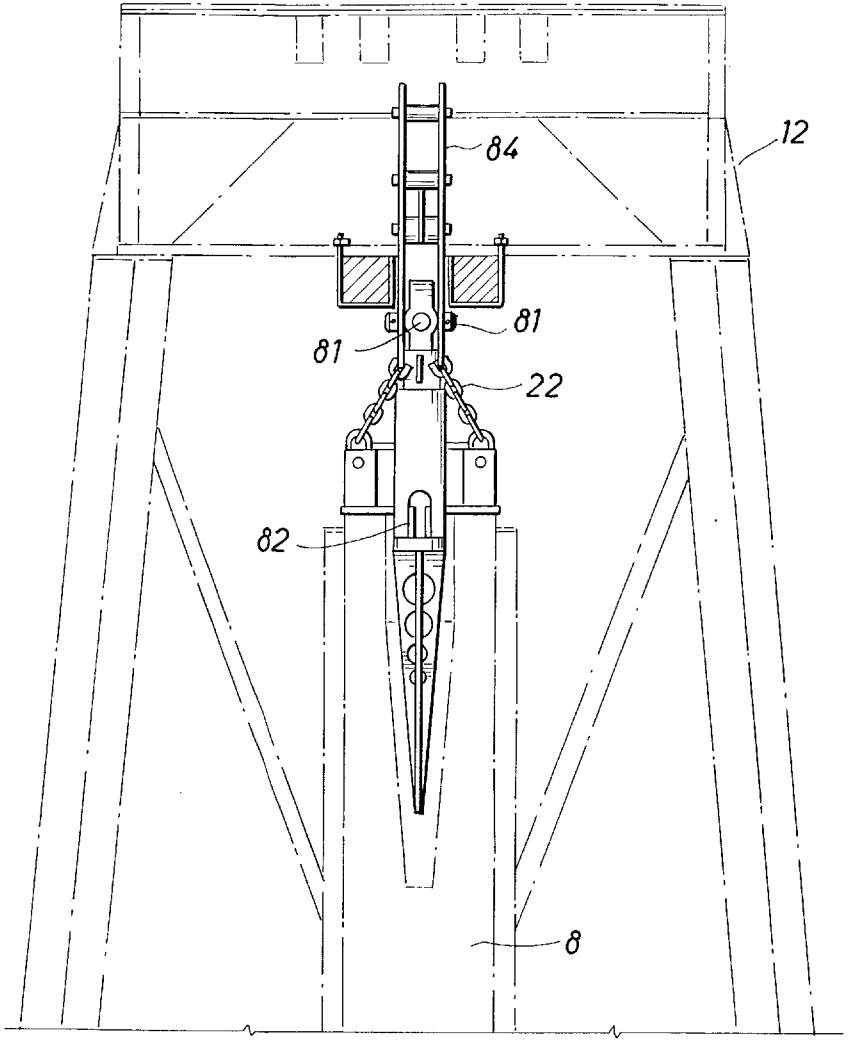
Figure 8D:
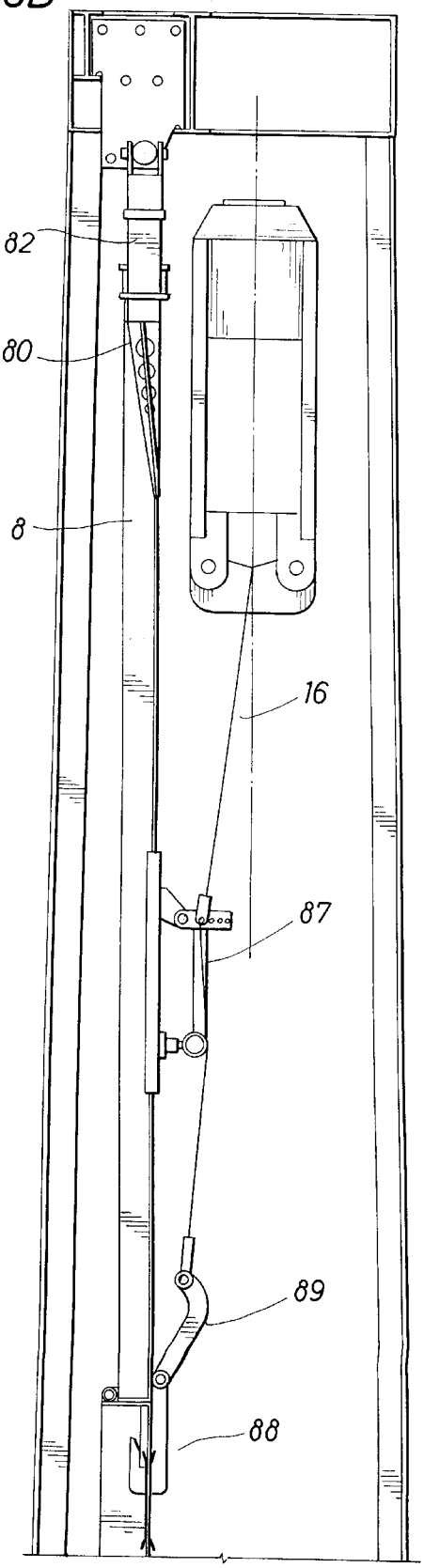
FIG. 8D is a side view of a lifting hook and guide for pulling torque guide sections vertically to the top of a rig mast.
Figure 8D:
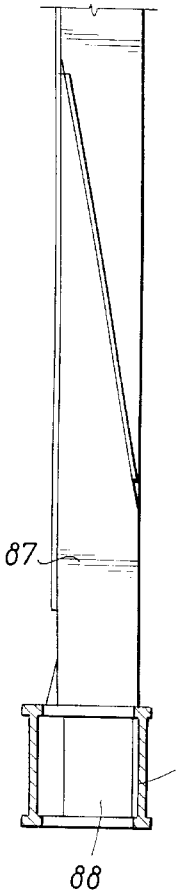
Figure 8D:
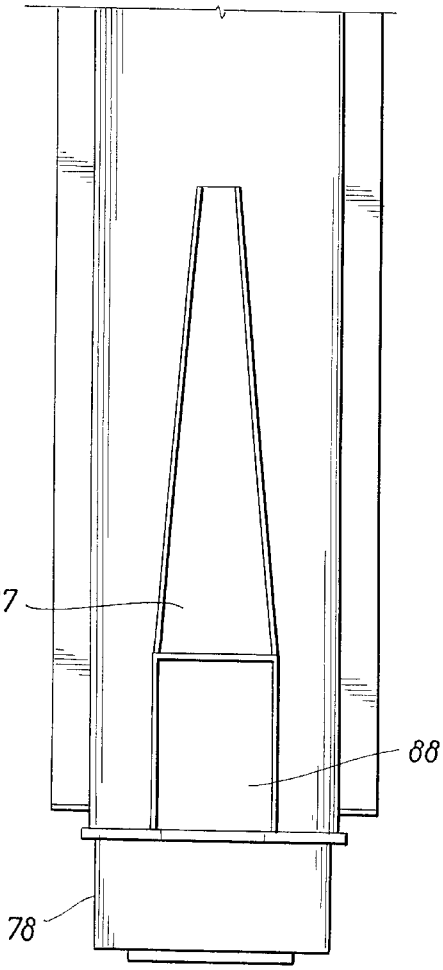
Figure 8D:
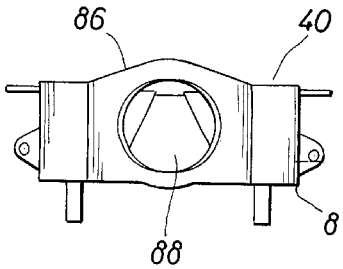

Referring now to FIG. 2C, the service mount ladder assembly provides not only a working ladder, but also a convenient semi-enclosed tray or channel 55 for housing utility and service cables. These cables extend from a service facility or other suitable source to the top drive unit. The service tray can conveniently be constructed of sheet metal, sheet metal with holes or metal hardware cloth. Steel hardware cloth is preferred. Utility service supply cables, control lines and service hoses are stored in the skid utility frame 55 during transport. This tray aids in making the top drive assembly fully self-sufficient. With all utility supply cables and service hoses contained and available in a portable pre-commissioned top drive assembly, it is possible to be up and running in a matter of a few hours and with a minimum of field connections. The self-contained utility cables and utility hoses allow the assembly to be moved into position, vertically erected into the mast, connected to the crown and lower substructure and the utilities and services connected to available generator power and existing service lines on the derrick. Preferably, the utility and services cables are fixed in the tray with loops that can extend when connected to the top drive. The loops are of sufficient length to extend the length of the torque guide above the service assembly. Similarly, cable loops are provided to connect the utility and services to the source. It is expedient to construct the service mount frame to house an air blower for cooling an electric drive motor and utility and service connectors. It is desirable that the air blower and connections be at about 72 feet (23.6 meters) elevation on the rig mast. The ladder allows easy access to these connections. A preferred assembly for an air blower and service connections is illustrated in FIGS. 7A, 7B and 7C. The blower 52 is attached to the service mount assembly by means of movable connection members 57. These are preferably hydraulic cylinders that can be extended or retracted to position the blower and service connections closer or farther away from the torque guide. This allows the service mount to be pulled close to the torque guide when installing the guide into the mast and then moving it away for operation. Such an adjustable positioning attachment greatly facilitates use of the top drive assembly in drilling rigs with masts of limited width. An electric service loop connection 54 connects to the top drive unit and connects to electric service cables in the ladder service tray. The blower hose 58 connects to the motor. A mud hose connects at one end to the top drive and at the other end to the existing mud or "kelly" hose of an existing rig. Hose supplied with the portable top drive assembly is long enough to allow the top drive unit to travel from the top to the bottom of the guide so that there is no need to extend or otherwise modify the existing mud hose or stand pipe. The blower and service mount frame are preferably mounted at an angle from the ladder to better fit in the mast without contacting angled brace members that are typically found in small rig masts.

Referring to FIG. 8, the crown hanger assembly (spear) connects to the torque guide at the top and supports it vertically. A suitable crown hanger assembly is shown in FIGS. 8A, 8B, 8C and 8D. The top connection shown in FIGS. 8A and 8B is connected to crown 12 of the derrick through mounting plates 84. This connection is, of course, made before the torque guide is pulled into place in the mast. It may be bolted, as shown, or otherwise suitably connected. The assembly is connected to structural members of the crown towards the rear (away from the open side of the mast and behind the centerline of the drill hole) since the torque guide must hang behind the centerline of the drill hole to properly position the top drive. The top section of torque guide (for example, section 8 of FIGS. 1, 2 and 8) is constructed with a top fitting 86, in which the top is a rounded tapered receptacle 88 and 87 designed to receive a matching tapered spear shown in FIGS. 8A and 8B. The spear 80 slides into the receptacle 86, and latches 82 engage the sides 88 of the top fitting. The latches are pinned at 83 to fall into latched position when the spear slides into the top fitting. These latches can be manually disengaged for disassembly of the torque guide. FIG. 8D illustrates the top connection assembled for use and also shows an embodiment of the connection between the traveling block and sections of the torque guide. Since the torque guide is behind the center line of the hole, and therefore the centerline of the traveling block, there must be means for pulling the torque guide into place without pulling it into the sides of the mast. In this embodiment this is accomplished by a hook 88, pivoting latch 87 and guide 83. Hook 89 engages the second from the top section of torque guide (for example section 7 of FIGS. 1, 2 and 8). Cable 16 is attached to the pivoting latch 89 and around guide 83. When cable 16 is tightened to pull the torque guide up into position, the pulling force is transmitted through 89 and 83 behind the traveling block centerline. The top connector could be designed to be pulled straight up the centerline of the drill hole under the traveling block, but it would have to be guided into position for connection to the crown. This could be done either manually or mechanically but may require more head room in the mast and more manual connection during rigup. Other designs to accomplish pulling and connection of the torque guide to the crown at a position behind the centerline of the drill hole will be apparent to those skilled in this art.

As a safety measure, the crown hanger will be loosely connected to the top of the mast by safety chains 22 and/or cable 23. These provide a backup should the latch connection inadvertently disengage. They are manually connected and disconnected.

Figure 9A:
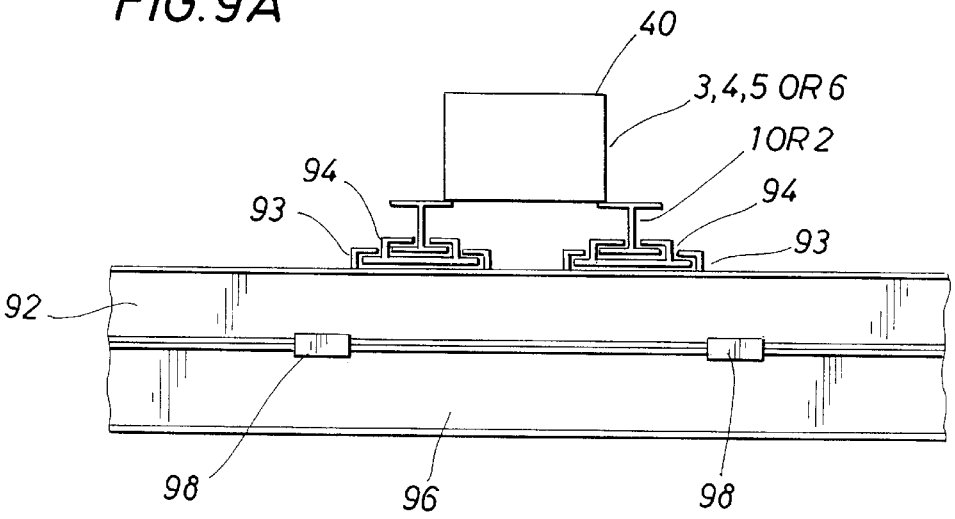
FIGS. 9A, 9B and 9C are schematic representations of a slidable connector for attaching the lower section of a torque guide to a drilling rig mast back spreader beam.

The lower end of the torque guide reaction assembly is preferably tied to a mast back spreader beam by slidable connection of the lower skid section beams to a cross beam of the mast, normally at an elevation at the top of the A-legs. The mast beam is typically a heavy beam that can easily accept the torque reaction of the top drive. An embodiment of a suitable connection for the torque guide to the rig mast beam is illustrated in FIG. 9. The torque guide skid section 1 or 2 is connected to connector 94. This connection is suitably a releasable, bolted connection. When made up, it is fixed, not slidable. Connector 94 is slidably or pivotally connected through the connector 93, which is attached to a torque reaction beam 92. This beam is preferably a steel I beam of about the same size and dimensions as the skid beams. This beam is preferably clamped 98 to the A-leg beam 92 of the rig. Connection 93 allows connection 94 (and therefore the torque guide assembly) to slide up or down as needed to accommodate expansion or contraction in height of the rig mast structure.

Figure 9B:
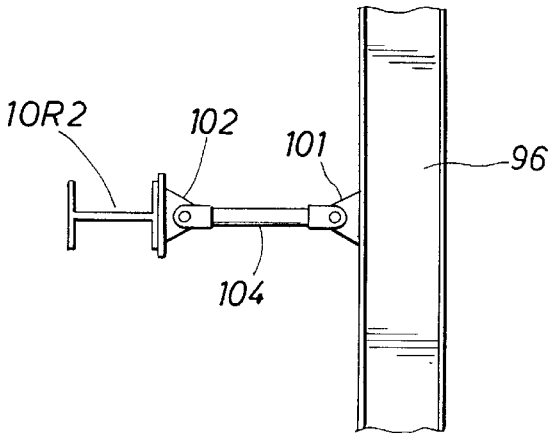
Figure 9C:
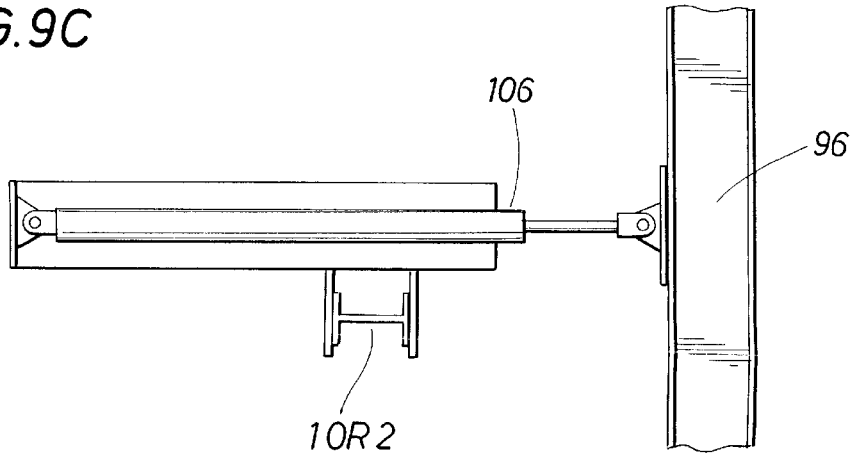

In another embodiment, the torque reaction assembly is tied to the mast beam by a pivoting connection such as illustrated in FIG. 9B. The torque guide skid sections 1 and 2 are connected to the mast beam 96 through a linkage 104 which is pinned at 101 and 102. By rotating pivots 101 and 102, the torque guide is allowed to move up or down in response to changes in the mast length. Similarly, another embodiment is shown in FIG. 9C. This embodiment also uses the double pivot principle but incorporates hydraulic cylinders 106 which can be extended to position the top drive axis over the mouse hole (approx. 3 ft±(1 meter) forward of the centerline). These two embodiments not only allow the torque guide to move up and down, but also allow it to move horizontally to position over the centerline of the drill hole or the centerline of the mouse hole in the platform floor. This ability greatly aids in changes of drill stands.

When a heavy load is hoisted, the load causes the mast to compress or squat as much as several centimeters. Moreover, changes in ambient temperature—and rigs are used in extreme climates with temperatures from lows of around −40° C. to highs of over 50° C.—will cause noticeable expansion or contraction of the mast. Since the torque guide may not expand or contract the same amount as the mast, it is important that the mast and torque guide not be rigidly attached. Otherwise, vertical change can cause buckling of either the mast or torque guide. The slide distance need not be more than a few centimeters. The slide may be lubricated or constructed with a plastic or other suitable coating or insert to facilitate movement. This slidable connection (or suitable substitute) that can be made up on site without modification of the rig structure is an important part of the portable top drive assembly.

It is preferred that the drive motor for the top drive be a direct current (D.C.) electric motor, although an AC motor or hydraulic drive may be used. Electric drive motors for drill rigs are typically direct current powered, supplied from a portable A.C. generator and rectified by an SRC (silicon rectification control) unit. Electric motors have the advantage of high power transfer efficiency (90% compared to about 70% for hydraulic), wide torque speed range, no oil leakage, long motor life and low maintenance cost. They have been proven in oilfield use, are generally familiar to industry people and are easily connected to the power supply available at most drilling sites.

If a D.C. electric drive is used, as preferred, an SRC unit may be supplied with the top drive assembly. If so, it is conveniently housed in separate storage such as a van or portable building.

Preferably, service storage facilities are provided for use with the portable top drive assembly. Such storage may be a portable building or van or any other suitable facility. The storage can also contain electrical and hydraulic feed cables, auxiliary hydraulic pumps to supply the hydraulic actuators on the top drive assembly and control lines. It can also provide a convenient connection system between the field power supply and the top drive unit. A preferred service housing is a portable building or van that is pre-wired for electric power (typically D.C. power) that need only be connected to the A.C. power source at the drill site. Preferred service storage will contain auxiliary hydraulic pumps (preferably redundant) to provide hydraulics for the hydraulic systems and an SRC to convert A.C. power to D.C. power. The van will also contain all control panels and control cable connections for the top drive unit operation. The utility and service cables and control lines are extended from the van to connect with matching lines and cables at the base of a torque guide assembly. It is desirable that the van also include a self-contained cable tray boom to allow positioning of the service supply cables at the lower end of the torque guide for easy connection to the cables contained in the top drive assembly service tray. Quick connection means attached to the cable and lines from the van and on the matching lines and cables in the torque guide assembly greatly facilitate connection of the top drive unit and reduced on-site fitting and modification.

Pre-commissioning

Since the portable top drive unit of this invention can contain all elements needed for installation and use—drive, torque guide, utility and services cable and hoses and connections that are carried with and mounted on the assembly—the system can be completely pre-commissioned. All electrical, hydraulic and control systems can be checked in actual operation and pre-tested to ensure no down time in the field. Since labor costs are as much as 60 percent of the day costs of a drilling rig, this is a great advantage. Moreover, correction of malfunctions and modification of components are more reliable and less costly if made in the shop rather than in the field.

Method of providing a top drive assembly to a drilling rig

One embodiment of the invention is a method of rigging a drilling derrick with a top drive assembly. The method is illustrated by the following description of the installation of the top drive assembly into a drilling rig. This description also helps illustrate the operation and advantages of the top drive assembly of the invention.

Installing the top drive assembly into a drilling rig

FIG. 2A illustrates the torque guide in position for pulling into the rig mast. A hinged skid section is shown in position on the platform floor. The upper section 2 lays on the floor, and section 1 rests on a sloped pipe ramp. This allows the assembly to be secured on a typical platform floor. Many are smaller than the total length of the skids. From this position the torque guide sections will be unfolded vertically into the mast. FIG. 2C shows a torque guide in its fully extended position. Beginning with the top section, or section next to the top as shown in FIG. 8, the torque guide is connected to the traveling block through a bail and pulled upward. Additional sections, being attached either by hinged or slidable connections, follow the top section into place until the torque guide sections and the attached skid section(s) hang vertically in the mast. The top section is attached to the crown, and the skid mount is attached to a lower section of the mast. It is preferable that the skid be slidably mounted to a horizontal mast beam with a connection means. The torque guide is vertically suspended from the crown. The torque guide reaction beam (typically an I beam) is attached to some strong member at the lower end of the rig mast or to the rig floor. It is preferably clamped to the mast structure (back spreader), as illustrated in FIG. 9. Connection of the skids of the torque guide to a strong mast beam absorbs the torque reaction of the torque guide. This connection places no undue stress on the rig mast. No expensive strength analysis or modification of the mast is typically required.

Complete rig-up of the portable assembly involves the following sequential steps:

1. The complete skid mounted assembly is pulled up a ramp to a point that a substantial portion of the skid can be laid flat on the platform under the mast.
2. Pins, straps or other connectors that hold the sections of the torque guide and skid assembly together for transport are removed.
3. The top connector—the spear in the preferred embodiment—is connected to the crown. This is done manually and is conveniently done before erecting the mast.
4. If a hook is attached to the traveling block, it is removed and replaced with a special top drive connection adapter or "bail".
5. A mudline is connected through the mudline extension provided with the service connections of the top drive assembly. Additionally, it is usually convenient to connect other utility and service connections before elevating the torque guide.
6. The traveling block is lowered into position to connect to the top section of the torque guide 6. The traveling block is attached to a latch hook (FIG. 8C) or other top connector and the assembly pulled into place. As it is pulled up, the hinged sections unfold. If hinged, the tension cables are tightened, preferably by a hydraulic system. If the sections are connected by slip joints, such as shown in FIG. 4, there is no need for the tensioning cables. The sections of the torque guide are held together by the slip joint.

7. The top connection is engaged as illustrated in FIG. 8.
8. The reaction beam is then attached to the lower section of the mast or to the platform floor. The bottom of the skid frame will be about 2 to 3 meters (6 to 9 feet) from the floor of the platform. If connected to the platform floor, the skids are mounted through an offset frame that allows for headroom clearance.
9. Utility and service storage is put into position to allow connection of the electric and hydraulic service lines and control cables in the utility tray of the skid section to be connected. The utility and control cables are typically pre-connected to the top unit.

At this point the top drive is operational and the derrick completely fitted for top drive operation.

With all the utility and service cables and control lines self-contained in the portable assembly, it is clearly possible to install a top drive in a land rig in a day or less. The day rate savings alone will justify much of the cost of the self-contained features of the portable top drive assembly.

These embodiments are illustrative of the invention, but other modifications and variations are within the scope of the following claims.

What is claimed is:

1. A method for use with a portable, self-contained top drive assembly and a drilling rig, the top drive assembly having a skid member, a top drive unit coupled to the skid member, a plurality of stacked torque guide sections positioned on the skid member, the torque guide sections linked together end to end with at least one of the torque guide sections coupled to the skid member, the torque guide sections capable of being rigidly secured together to form a torque guide, the drilling rig having a mast and a crown, the method comprising the steps of:

locating the skid member near the mast;

extending a line from the crown;

attaching the line to the top drive assembly; and hoisting the linked plurality of torque guide sections into a linear vertical configuration, the skid member remaining coupled to one of the torque guide sections during hoisting.

2. The method of claim 1 wherein the hoisting includes hoisting at least two of the stacked torque guide sections into the linear vertical configuration without reattaching the line.

3. The method of claim 1 further comprising:

connecting one of the torque guide sections at the top to the crown.

4. The method of claim 1 further comprising:

connecting one of the torque guide sections at the bottom to the mast.

5. The method of claim 1 wherein the hoisting includes hoisting all of the stacked torque guide sections into a linear vertical configuration without reattaching the line.

6. The method of claim 1 wherein the line comprises a cable.

7. The method of claim 1 wherein the skid member comprises first and second hinged sections, and wherein the step of locating the skid member near the mast includes:

moving the skid member up a ramp adjacent to the mast where the first section is laid flat on a platform under the mast and the second section remains at an angle on the ramp.

* * * * *